US012779320B2

(12) United States Patent
Wei

(10) Patent No.: US 12,779,320 B2
(45) Date of Patent: Nov. 3, 2026

(54) MULTI-CLAW GAME MACHINE

(71) Applicant: PAOKAI ELECTRONIC ENTERPRISE CO., LTD., Kaohsiung City (TW)

(72) Inventor: Ming-Shan Wei, Kaohsiung City (TW)

(73) Assignee: PAOKAI ELECTRONIC ENTERPRISE CO., LTD., Kaohsiung City (TW)

( * ) Notice: Subject to any disclaimer, the term of this patent is extended or adjusted under 35 U.S.C. 154(b) by 413 days.

(21) Appl. No.: 18/512,768

(22) Filed: Nov. 17, 2023

(65) Prior Publication Data

US 2025/0090942 A1 Mar. 20, 2025

(30) Foreign Application Priority Data

Sep. 18, 2023 (TW) ..... 112135494

(51) Int. Cl.
*A63F 9/30* (2006.01)

(52) U.S. Cl.
CPC ..... *A63F 9/30* (2013.01); *A63F 2300/64* (2013.01)

(58) Field of Classification Search
CPC ..... A63F 9/30; A63F 2300/64
See application file for complete search history.

(56) References Cited

U.S. PATENT DOCUMENTS 4,718,667 A * 1/1988 Shoemaker, Jr. ..... A63F 9/30 212/320
5,549,372 A * 8/1996 Lewis ..... G07F 17/32 312/265.5
5,711,530 A * 1/1998 Lewis ..... G07F 17/3253 273/448
6,234,487 B1 * 5/2001 Shoemaker, Jr. .... B25J 15/0246 273/447
6,598,881 B1 * 7/2003 Shoemaker, Jr. ..... A63F 9/30 273/447

(Continued)

FOREIGN PATENT DOCUMENTS

CN 108114466 A 6/2018
CN 221432118 U * 7/2024 ..... A63F 9/30

(Continued)

OTHER PUBLICATIONS

Search Report appended to an Office Action, which was issued to Taiwanese counterpart application No. 112135494 by the TIPO on May 21, 2024, with an English translation thereof.

*Primary Examiner* — Raleigh W Chiu
(74) *Attorney, Agent, or Firm* — WPAT, PC

(57) ABSTRACT

A multi-claw game machine includes a housing, an operating mechanism, and a sensor module. The housing defines a pick-up region and an initial region. The operating mechanism includes a movable base seat, and a plurality of claws disposed on the base seat. The sensor module includes a processor and an operating interface. The processor is for switching the multi-claw game machine from a standby state in which the base seat is located in the initial region, to an operating state in which the base seat is movable away from the initial region. The operating interface controls the base seat to move toward and/or within the pick-up region after the multi-claw game machine is switched to the operating state, and transmits an object-picking signal to the claws to activate the claws to perform a gripping action.

10 Claims, 6 Drawing Sheets

(56) References Cited

U.S. PATENT DOCUMENTS

| | | | | |
|---|---|---|---|---|
| 9,526,978 | B1 * | 12/2016 | Shoemaker, Jr. | G07F 17/3251 |
| 11,376,491 | B2 * | 7/2022 | Tsai | G07F 17/3202 |
| 2003/0090065 | A1 * | 5/2003 | Carter, Jr. | G07F 17/3297 273/447 |
| 2021/0104133 | A1 | 4/2021 | Lin | |
| 2024/0325875 | A1 * | 10/2024 | Fukazawa | A63F 9/30 |
| 2024/0428662 | A1 * | 12/2024 | Nagata | G07F 17/3297 |
| 2024/0428663 | A1 * | 12/2024 | Ogawa | G07F 17/3297 |
| 2025/0090941 | A1 * | 3/2025 | Wei | G07F 17/3267 |
| 2025/0090942 | A1 * | 3/2025 | Wei | A63F 9/30 |
| 2025/0191449 | A1 * | 6/2025 | Fukazawa | G07F 17/3216 |
| 2025/0295985 | A1 * | 9/2025 | Lin | A63F 9/30 |
| 2025/0325897 | A1 * | 10/2025 | Wei | A63F 9/30 |
| 2026/0021377 | A1 * | 1/2026 | Wei | A63F 9/30 |

FOREIGN PATENT DOCUMENTS

| | | | | | |
|---|---|---|---|---|---|
| DE | 60107966 | T2 | * | 12/2005 | G07F 17/3297 |
| GB | 2448337 | A | * | 10/2008 | G07F 11/44 |
| JP | 2010284276 | A | | 12/2010 | |
| JP | WO2009034903 | A1 | * | 12/2010 | G07F 17/3297 |
| JP | 3247358 | U | | 7/2024 | |
| TW | M554372 | U | | 1/2018 | |
| TW | M559199 | U | | 5/2018 | |
| TW | M634188 | U | | 11/2022 | |
| WO | WO-9208530 | A1 | * | 5/1992 | G07F 17/32 |
| WO | WO-2008080191 | A1 | * | 7/2008 | G07F 11/165 |
| WO | WO-2021229989 | A1 | * | 11/2021 | G07F 17/3297 |
| WO | WO-2024166488 | A1 | * | 8/2024 | G07F 17/3253 |
| WO | WO-2025094741 | A1 | * | 5/2025 | A63F 9/30 |

* cited by examiner

MULTI-CLAW GAME MACHINE

CROSS-REFERENCE TO RELATED APPLICATION

This application claims priority to Taiwanese Invention Patent Application No. 112135494, filed on Sep. 18, 2023, which is incorporated by reference herein in its entirety.

FIELD

The present disclosure relates to a game machine, and more particularly to a multi-claw game machine.

BACKGROUND

Referring to FIG. 1, a conventional crane game machine 1 includes a housing 10 defining an inner space 100 for retaining a plurality of target articles (not shown), a claw mechanism 11 disposed in the inner space 100 for gripping the target articles, and an operation interface 12 connected to the housing 10 and operable to control the claw mechanism 11. In particular, because the inner space 100 allows a management personnel to freely place the target articles therein, the inner space 100 may be decorated with different gadgets and/or may accommodate various kinds of target articles to attract players to play. Accordingly, such game machines have become quite prevalent in recent years. In response to the various kinds of target articles, various models of the game machines have been developed.

However, regardless of how the crane game machines evolve, a standard game mode of such game machine, which only controls one claw at a time, may not be exciting for the players.

SUMMARY

Therefore, an object of the disclosure is to provide a multi-claw game machine.

According to the disclosure, the multi-claw game machine including a housing, a track module, an operating mechanism, and a sensor module. The housing includes a main body that defines an inner space, and a partition that is disposed in the inner space and that extends in a left-right direction. The partition divides the inner space into a pick-up region and an initial region that are arranged along a front-rear direction perpendicular to the left-right direction. The pick-up region is located in front of the initial region. The initial region has a discharge opening at a bottom thereof. The track module is arranged in the inner space, is located above the partition, and extends in the front-rear direction. The operating mechanism is disposed on the track module, and includes a base seat that extends in the left-right direction and that is reciprocatingly movable on the track module in the front-rear direction, a plurality of claws that are disposed on the base seat and that are spaced apart from each other in the left-right direction, and a driving motor that is connected to the base seat for providing power to move the base seat on the track module. The sensor module is in communication with the operating mechanism, and includes, optionally, a sensor, a processor and an operating interface. The sensor is disposed on the track module, and defines a reference point aligned with the partition along a vertical direction. The processor is in communication with the sensor and the driving motor, and is used for switching, after receiving an activation signal, the multi-claw game machine from a standby state in which the base seat is located in the initial region, to an operating state in which the base seat is permitted to move away from the initial region. The operating interface is in communication with to the processor and the claws, is operable to control the base seat to move toward and/or within the pick-up region after the processor switches the multi-claw game machine to the operating state, and is operable to transmit an object-picking signal to the claws to activate the claws to perform a gripping action. The processor switches the multi-claw game machine to the standby state after the claws performs the gripping action.

BRIEF DESCRIPTION OF THE DRAWINGS

Other features and effects related to the present disclosure will be clearly presented in the embodying manner with reference to the drawings.

DETAILED DESCRIPTION

Figure 1:
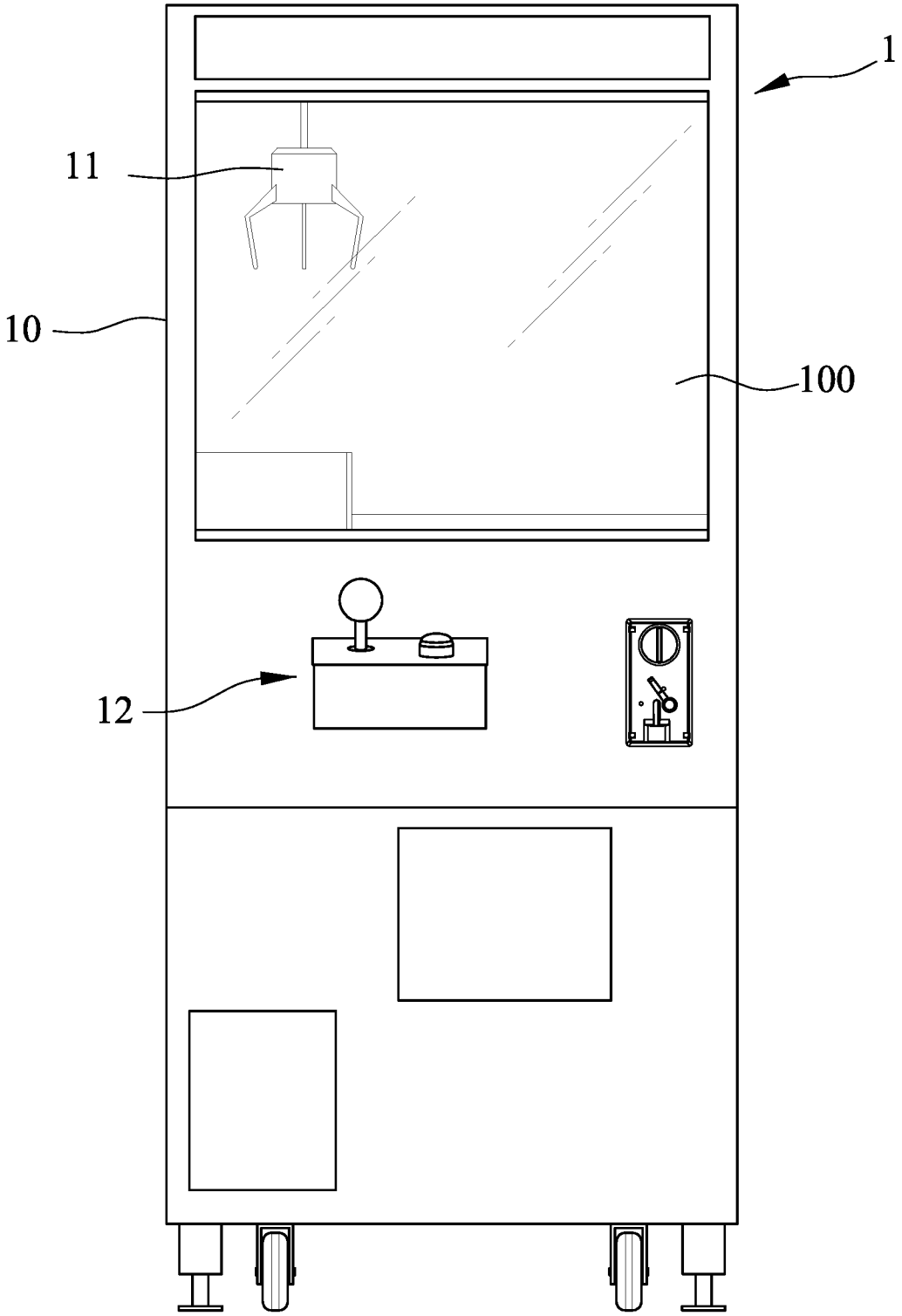
FIG. 1 PRIOR ART
FIG. 1 is a front view, illustrating a conventional crane game machine.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
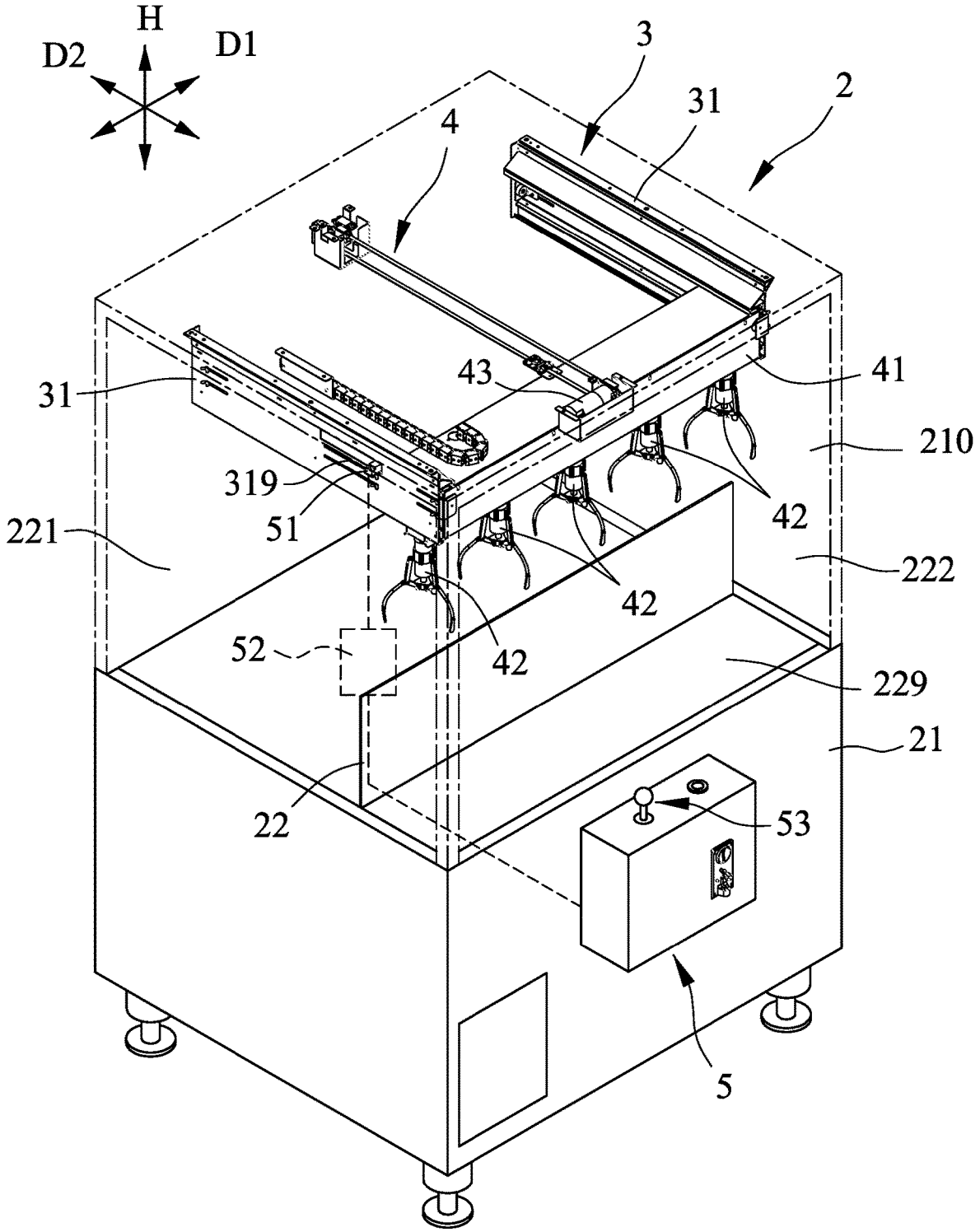
FIG. 2 is a perspective view, illustrating a first embodiment of a multi-claw game machine of this disclosure.

Referring to FIG. 2, a first embodiment of a multi-claw game machine according to the present disclosure includes a housing 2, a track module 3, an operating mechanism 4 disposed on the track module 3, and a sensor module 5 in communication with the operating mechanism 4. The housing 2 includes a main body 21 defining an inner space 210, and a partition 22 disposed in the inner space 210 and extending in a left-right direction (D1). The partition 22 divides the inner space 210 into a pick-up region 221 and an initial region 222 that are arranged along a front-rear direction (D2) perpendicular to the left-right direction (D1). The pick-up region 221 is located in front of the initial region 222. The initial region 222 has a discharge opening 229 at a bottom thereof. Specifically, the housing 2 defines a gaming environment. The pick-up region 221 may accommodate any kind of target articles to be picked up. The target articles herein may be, but not limited to, snack packs with a lighter weight and a lower unit price, so as to correspond to the characteristics of the first embodiment.

Figure 3:
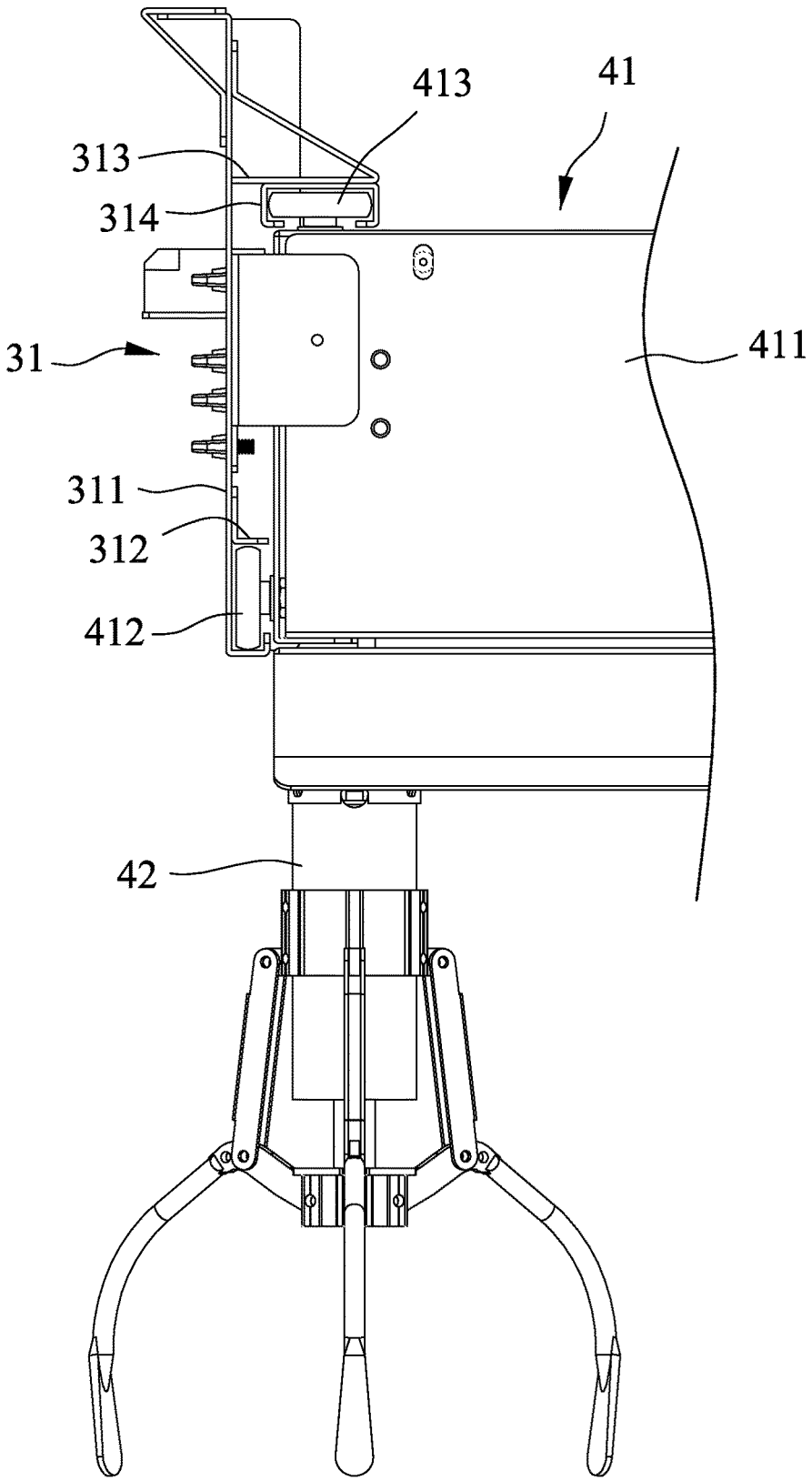
FIG. 3 is a fragmentary enlarged front view, illustrating a track module and an operating mechanism of the first embodiment.

Referring to FIG. 3 and in combination with FIG. 2, the track module 3 is arranged in the inner space 210, is located above the partition 22, and extends in the front-rear direction (D2). The track module 3 includes two slide rails 31 spaced apart from each other in the left-right direction (D1) and located above the pick-up region 221 and the initial region 222. Each of the slide rails 31 has a first base plate 311 extending in a vertical direction (H), a first track 312 formed on the first base plate 311, a second base plate 313 bent toward another one of the slide rails 31 from an upper end of the first base plate 311 and extending in the left-right direction (D1), and a second track 314 formed on the second base plate 313. In other words, each of the slide rails 31 is formed with a first track 312 and a second track 314. Furthermore, the first base plate 311 of one of the slide rails 31 defines an adjusting slot 319 that extends in the front-rear direction (D2).

The operating mechanism 4 includes the base seat 41 extending in the left-right direction (D1) and reciprocatingly movable on the track module 3 in the front-rear direction (D2), five claws 42 disposed on the base seat 41 and spaced apart from each other along the left-right direction (D1), and a driving motor 43 connected to the base seat 41 and configured to provide power for moving the base seat 41 on the track module 3. The base seat 41 includes a seat body 411, two first rollers 412 slidably and respectively disposed on the first tracks 312 of the slide rails 31, and two second rollers 413 slidably and respectively disposed on the second tracks 314 of the slide rails 31. As shown in FIG. 3, the first rollers 412 (only one is shown) of the base seat 41 are respectively disposed on two opposite lateral sides of the seat body 411 to form positioning points, and the second rollers 413 (only one is shown) are arranged on a top end of the seat body 411 to form positioning points, so that the first rollers 412 and the second rollers 413 are capable of positioning the base seat 41 in different directions (i.e., the left-right direction (D1) and the vertical direction (H)), and that the reciprocating movement of the base seat 41 along the track module 3 is more stable.

Figure 4:
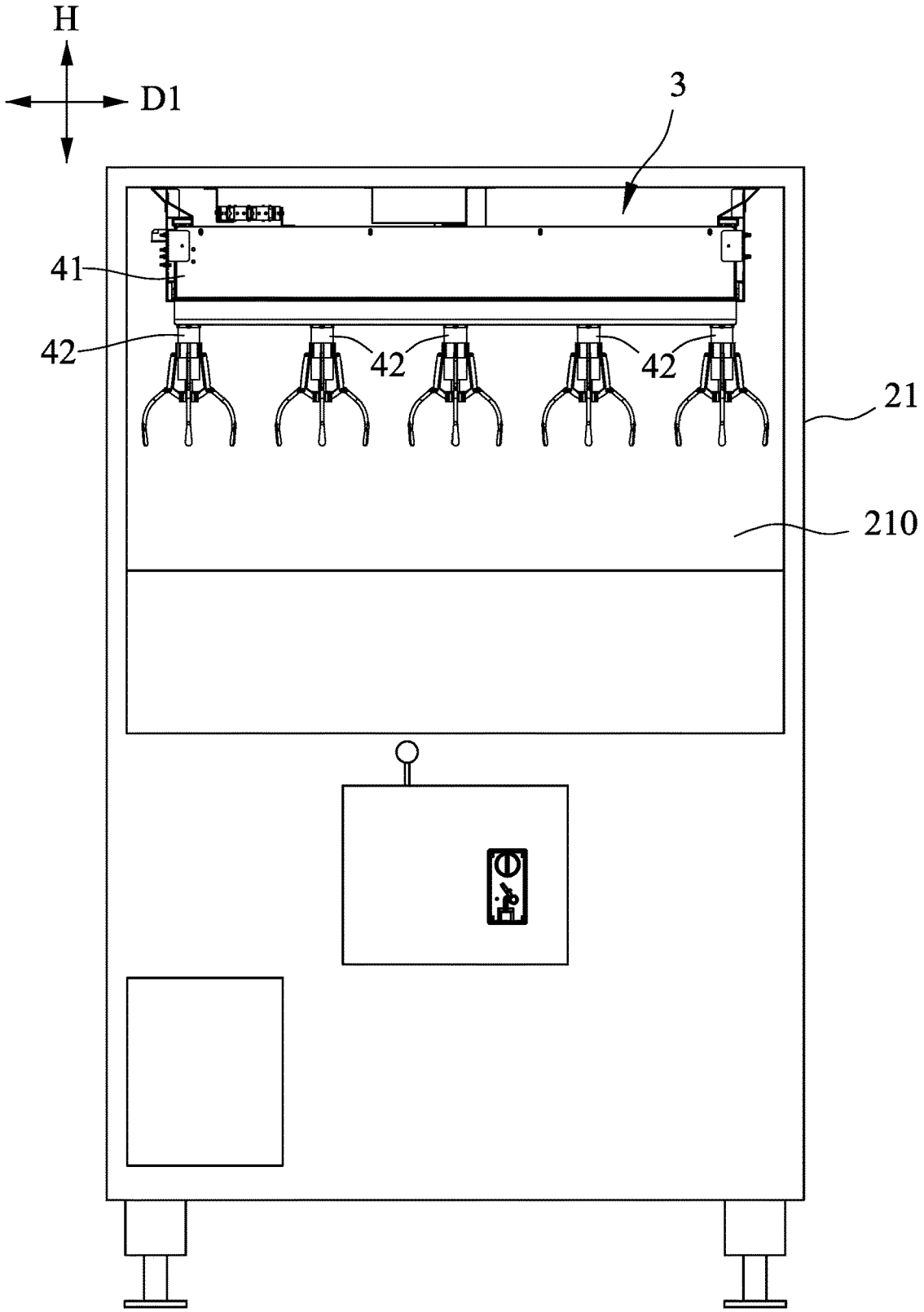
FIG. 4 is a front view, illustrating five claws of the operating mechanism.

Referring to FIG. 4 and in cooperation with FIG. 2, when the driving motor 43 provides the power, the base seat 41 is moved on the track module 3 in the front-rear direction (D2). The five claws 42 correspondingly cover a range of a width of the inner space 210 in the left-right direction (D1), so the claws 42 only need to move back and forth in the front-rear direction (D2) with the base seat 41 so as to be capable of gripping the target articles within a certain range.

The sensor module 5 includes a sensor 51 positioned in the adjusting slot 319, movable in the front-rear direction (D2) and defining a reference point that is aligned with the partition 22 along the vertical direction (H), a processor 52 in communication with the sensor 51 and the driving motor 43, and an operating interface 53 in communication with the processor 52 and the claws 42. In some embodiments, the sensor 51 is configured as a photosensor for determining a location of the base seat 41. However, the sensor 51 only needs to set a reference point representing a junction between the pick-up region 221 and the initial region 222, and is not limited to be a photosensor. Specifically, the processor 52 is a central controller or a chip mainly used to control an operating mode of the first embodiment, and is used for switching, after receiving an activation signal from insertion of a coin, the multi-claw game machine from a standby state in which the base seat 41 is in the initial region 222, to an operating state in which the base seat 41 is permitted to move away from the initial region 222, in particular, move from the initial region 222 to the reference point. The operating interface 53 is operable to control the base seat 41 to move toward and/or within the pick-up region 221 in the front-rear direction (D2) after the processor 52 switches the multi-claw game machine to the operating state, and is operable to transmit an object-picking signal to the claws 42 to activate the claws 42 to perform a gripping action. The processor 52 switches the multi-claw game machine to the standby state (i.e., the base seat 41 moves back to the initial region 222) after the claws 42 performs the gripping action.

Figure 5:
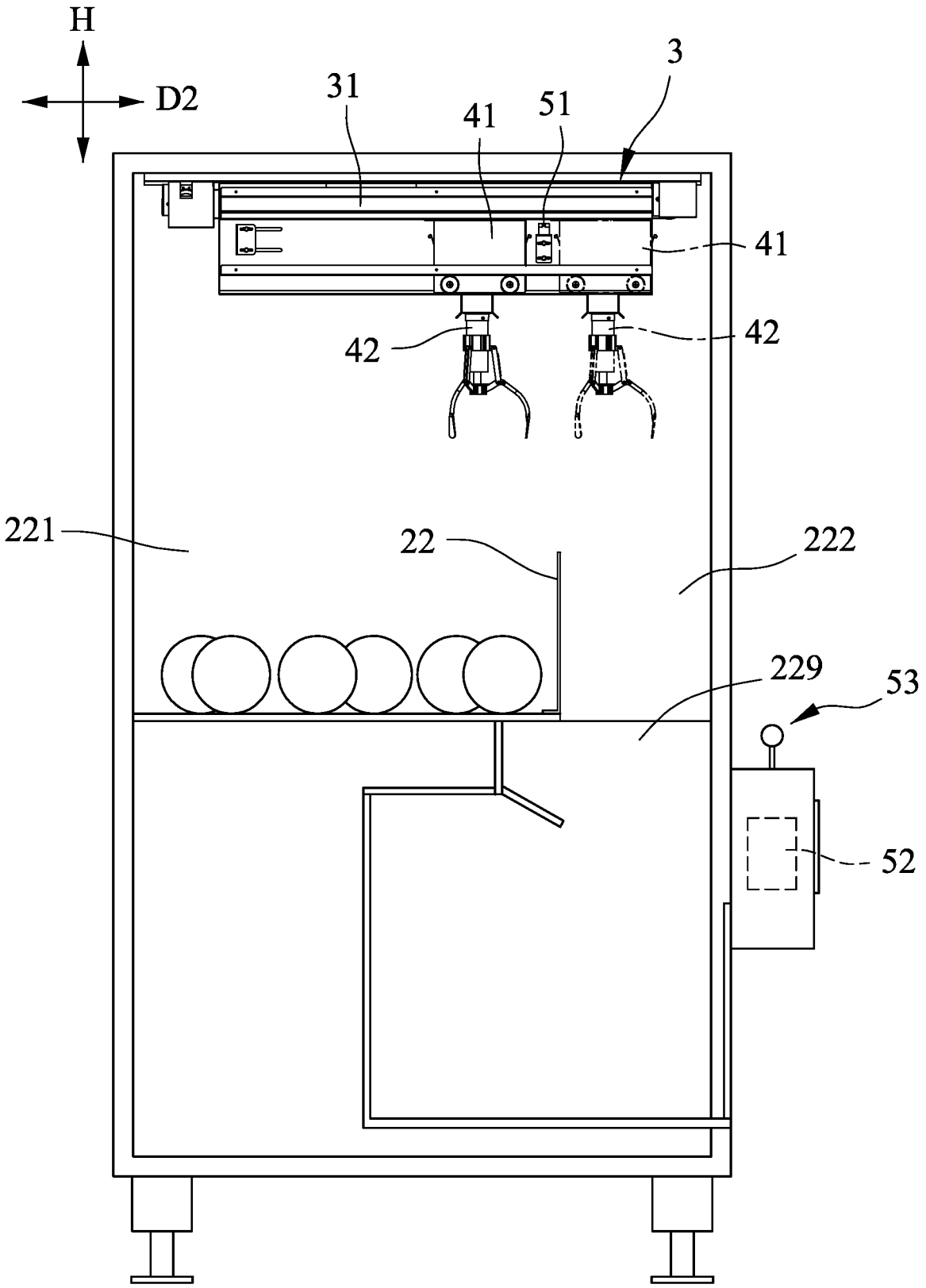
FIG. 5 is a schematic side view, illustrating operation of the first embodiment.

Referring to FIG. 5 and in cooperation with FIG. 2, in terms of an actual operation procedure, after a player inserts a coin to activate the first embodiment, the processor 52 switches the multi-claw game machine from the standby state to the operating state. At this time, since the base seat 41 is first moved together with the claws 42 above the pick-up region 221, the player is unable to lower the claws 42 when the claws 42 are located above the initial region 222 or the partition 22. Then, the player operates the operating interface 53 to make the driving motor 43 drive the base seat 41 so as to move on the track module 3 in the front-rear direction (D2), thereby aligning the claws 42 with some target articles that are to be gripped. When the player inputs the object-picking signal through the operating interface 53, the claws 42 are simultaneously lowered and closed to grip the target articles. It is worth noting that, in order to ensure that the player may have a better play experience in use of the first embodiment, the claws 42 may be fully closed when gripping the target articles and not loosened until the base seat 41 moves back to the initial region 222, ensuring that the player may use the claws 42 to grip the target articles. Finally, when the base seat 41 moves back to the initial region 222 (i.e., the processor 52 switches the multi-claw game machine to the standby state), the claws 42 are loosened so that the target articles are released via the discharge opening 229.

Figure 6:
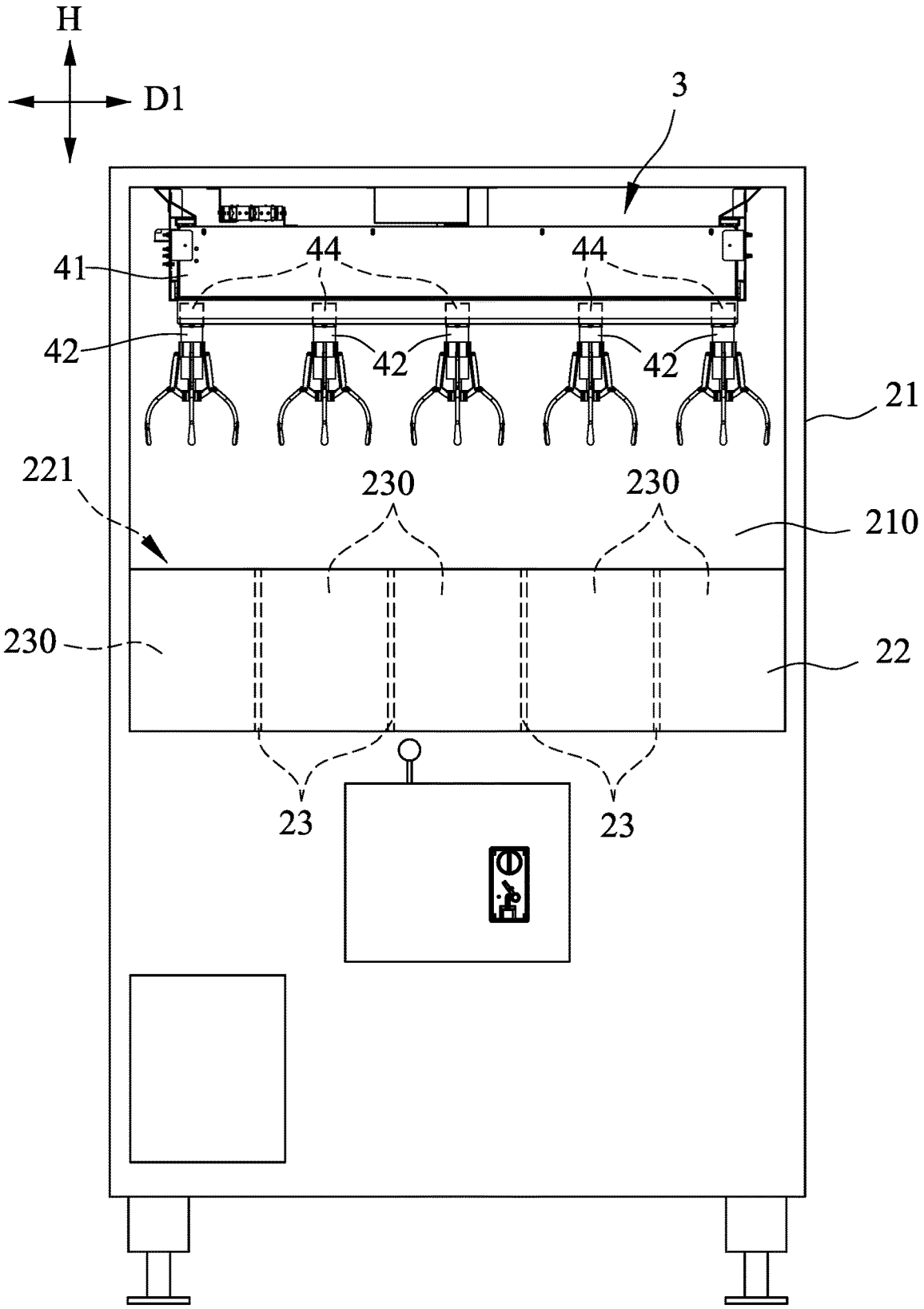
FIG. 6 is a front view, illustrating a second embodiment of the multi-claw game machine of this disclosure.

Referring to FIG. 6, a second embodiment of the multi-claw game machine of this disclosure differs from the first embodiment in that: The housing 2 further includes a plurality of dividing plates 23 disposed in the pick-up region 221 and spaced apart from each other along the left-right direction (D1) so as to divide the pick-up region 221 into a plurality of sub-regions 230 respectively corresponding to the claws 42. That is to say, based on relative positions of the five claws 42, the dividing plates 23 of the second embodiment divides the pick-up region 221 into five sub-regions 230 that are respectively for the five claws 42 in the game. In a situation where the pick-up region 221 is partitioned, the five sub-regions 230 may contain different types of the target articles. By such, in addition to attracting different players with various types of the target articles, diversity of the game may also be further enhanced.

In another aspect of the second embodiment, the operating mechanism 4 further includes a plurality of driving coils 44 respectively corresponding to the claws 42 and respectively used for providing driving electrical energy to make the claws 42 execute a closing action when gripping the target articles. In one example, each of the driving coils 44 may provide different driving electrical energy. The force applied by the claws 42 may be adjusted by adjusting the driving power provided by the driving coils 44. Specifically, the driving electrical energy provided by a driving coil 44 that drives the claw 42 corresponding to a sub-region 230 containing high-priced target articles may be lowered, thereby controlling both probability and cost while providing a more diversified game mechanism.

In summary, the multi-claw game machine of this disclosure uses the sensor 51 cooperating with the partition 22 to divide the inner space 210 into the pick-up region 221 and the initial region 222. By virtue of the cooperation of the operating mechanism 4 and the sensor module 5, the claws 42 may be lowered and closed by the operating interface 53 only after the processor 52 switches the multi-claw game machine to the operating state. Each of the claws 42 may be set to have a specific claw force that may easily grip the target articles, so that players may experience gripping multiple target articles at the same time, thereby generating a sense of fun that is different from the conventional claw machine. Furthermore, the claws 42 may only be operated to perform a gripping action within the pick-up region 221. Thus, the claws 42 are prevented from being mistakenly operated in the initial region 222 where no target article is available.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A multi-claw game machine, comprising:

a housing including a main body that defines an inner space, and a partition that is disposed in said inner space and that extends in a left-right direction, said partition dividing said inner space into a pick-up region and an initial region that are arranged along a front-rear direction perpendicular to the left-right direction, said initial region having a discharge opening at a bottom thereof;

a track module arranged in said inner space, located above said partition, and extending in the front-rear direction;

an operating mechanism disposed on said track module, and including a base seat that extends in the left-right direction and that is reciprocatingly movable on said track module in the front-rear direction, a plurality of claws that are disposed on said base seat and that are spaced apart from each other in the left-right direction, a driving motor that is connected to said base seat for providing power to move said base seat on said track module, and a plurality of driving coils respectively corresponding to said claws and respectively configured to provide driving electrical energy to drive said claws to execute a closing action, wherein said plurality of claws are configured to simultaneously lower toward respective target articles in said pick-up region; and a sensor module in communication with said operating mechanism and comprising:

a processor that is in communication with said driving motor, and that is used for switching, after receiving an activation signal, said multi-claw game machine from a standby state in which said base seat is located in said initial region, to an operating state in which said base seat is permitted to move away from said initial region; and an operating interface that is in communication with to said processor and said claws, that is operable to control said base seat to move toward and/or within said pick-up region after said processor switches said multi-claw game machine to the operating state, and that is operable to transmit an object-picking signal to said claws to activate said claws to perform a gripping action;

wherein in the front-rear direction, said initial region is located on a side closer to said operating interface;

and wherein said processor switches said multi-claw game machine to the standby state after said claws performs the gripping action.

2. The multi-claw game machine as claimed in claim 1, wherein said operating mechanism includes five of said claws.

3. The multi-claw game machine as claimed in claim 1, wherein said track module includes two slide rails spaced apart from each other in the left-right direction, each of said slide rails having a first base plate that extends in the vertical direction and a first track that is formed on said first base plate, said base seat of said operating mechanism having a seat body and two first rollers that are slidably and respectively disposed on said first tracks of said slide rails.

4. The multi-claw game machine as claimed in claim 3, wherein said first base plate of at least one of said slide rails defines an adjusting slot that extends in the front-rear direction, said sensor of said sensor module being positioned in said adjusting slot, and being movable in the front-rear direction.

5. A multi-claw game machine, comprising:

a housing including a main body that defines an inner space, and a partition that is disposed in said inner space and that extends in a left-right direction, said partition dividing said inner space into a pick-up region and an initial region that are arranged along a front-rear direction perpendicular to the left-right direction, said initial region having a discharge opening at a bottom thereof;

a track module arranged in said inner space, located above said partition, and extending in the front-rear direction;

an operating mechanism disposed on said track module, and including a base seat that extends in the left-right direction and that is reciprocatingly movable on said track module in the front-rear direction, a plurality of claws that are disposed on said base seat and that are spaced apart from each other in the left-right direction, a driving motor that is connected to said base seat for providing power to move said base seat on said track module, and a plurality of driving coils respectively corresponding to said claws and respectively configured to provide driving electrical energy to drive said claws to execute a closing action; and a sensor module in communication with said operating mechanism and comprising:

a processor that is in communication with said driving motor, and that is used for switching, after receiving an activation signal, said multi-claw game machine from a standby state in which said base seat is located in said initial region, to an operating state in which said base seat is permitted to move away from said initial region; and an operating interface that is in communication with to said processor and said claws, that is operable to control said base seat to move toward and/or within said pick-up region after said processor switches said multi-claw game machine to the operating state, and that is operable to transmit an object-picking signal to said claws to activate said claws to perform a gripping action;

wherein in the front-rear direction, said initial region is located on a side closer to said operating interface;

wherein said processor switches said multi-claw game machine to the standby state after said claws performs the gripping action; and wherein said housing further includes a plurality of dividing plates disposed in said pick-up region, spaced apart from each other along the left-right direction, and dividing said pick-up region into a plurality of sub-regions that respectively correspond to said claws.

6. The multi-claw game machine as claimed in claim 5, wherein each of said driving coils is configured to provide different driving electrical energy.

7. A multi-claw game machine, comprising:

a housing including a main body that defines an inner space, and a partition that is disposed in said inner space and that extends in a left-right direction, said partition dividing said inner space into a pick-up region and an initial region that are arranged along a front-rear direction perpendicular to the left-right direction, said initial region having a discharge opening at a bottom thereof;

a track module arranged in said inner space, located above said partition, and extending in the front-rear direction;

an operating mechanism disposed on said track module, and including a base seat that extends in the left-right direction and that is reciprocatingly movable on said track module in the front-rear direction, a plurality of claws that are disposed on said base seat and that are spaced apart from each other in the left-right direction, a driving motor that is connected to said base seat for providing power to move said base seat on said track module, and a plurality of driving coils respectively corresponding to said claws and respectively configured to provide driving electrical energy to drive said claws to execute a closing action; and a sensor module in communication with said operating mechanism and comprising:

a processor that is in communication with said driving motor, and that is used for switching, after receiving an activation signal, said multi-claw game machine from a standby state in which said base seat is located in said initial region, to an operating state in which said base seat is permitted to move away from said initial region; and an operating interface that is in communication with to said processor and said claws, that is operable to control said base seat to move toward and/or within said pick-up region after said processor switches said multi-claw game machine to the operating state, and that is operable to transmit an object-picking signal to said claws to activate said claws to perform a gripping action;

wherein in the front-rear direction, said initial region is located on a side closer to said operating interface;

and wherein said processor switches said multi-claw game machine to the standby state after said claws performs the gripping action; and wherein said sensor module further includes a sensor disposed on said track module and in communication with said processor, said sensor defining a reference point aligned with said partition along a vertical direction.

8. The multi-claw game machine as claimed in claim 7, wherein said base seat is moved from said initial region to said reference point when said multi-claw game machine is switched from said standby state to said operating state.

9. The multi-claw game machine as claimed in claim 1, wherein said track module includes two slide rails spaced apart from each other in the left-right direction, each of said slide rails having a base plate that extends in the left-right direction and a track that is formed on said base plate, said base seat of said operating mechanism having a seat body and two rollers that are slidably and respectively disposed on said tracks of said slide rails.

10. The multi-claw game machine as claimed in claim 3, wherein each of said slide rails further includes a second base plate that is bent toward another one of said slide rails from an upper end of said first base plate and that extends in the left-right direction and a second track that is formed on said second base plate, said base seat of said operating mechanism further includes two second rollers that are slidably and respectively disposed on said second tracks of said slide rails.

* * * * *